US005700423A

United States Patent [19]

Gao

[11] Patent Number: 5,700,423

[45] Date of Patent: Dec. 23, 1997

[54] HEARTH ROLL WITH SUPERIOR ENDURANCE CAPACITY

[75] Inventor: Yang Gao, Saitama-ken, Japan

[73] Assignee: Praxair S.T. Technology, Inc., Danbury, Conn.

[21] Appl. No.: 518,350

[22] Filed: Aug. 23, 1995

[30] Foreign Application Priority Data

Aug. 26, 1994 [JP] Japan ..... 6-225590

[51] Int. Cl.[6] ..... C21D 1/00; C23C 4/10

[52] U.S. Cl. ..... 266/103; 428/469; 428/472; 428/701; 428/702; 432/8; 432/246

[58] Field of Search ..... 428/457, 701, 428/702, 472, 469; 432/8, 246; 206/103

[56] References Cited

U.S. PATENT DOCUMENTS

| | | | |
|---|---|---|---|
| 3,837,894 | 9/1974 | Tucker, Jr. | 117/70 A |
| 4,124,737 | 11/1978 | Wolfa et al. | 428/640 |
| 4,505,384 | 3/1985 | Albrecht et al. | 415/174 |
| 4,882,689 | 11/1989 | Fukubayashi et al. | 428/472 |
| 4,996,117 | 2/1991 | Chu et al. | 428/633 |
| 5,032,557 | 7/1991 | Taira et al. | 501/135 |
| 5,070,587 | 12/1991 | Nakahira et al. | 29/132 |

FOREIGN PATENT DOCUMENTS

| | | |
|---|---|---|
| 6056058 | 4/1981 | Japan . |
| 60-141861 | 7/1985 | Japan . |
| 62-54848 | 11/1987 | Japan . |
| 63-47379 | 2/1988 | Japan . |
| 63-199857 | 8/1988 | Japan . |
| 64258 | 1/1989 | Japan . |
| 2270955 | 11/1990 | Japan . |
| 1199483 | 7/1970 | United Kingdom . |

*Primary Examiner*—Archene Turner
*Attorney, Agent, or Firm*—Robert J. Feltovic

[57] ABSTRACT

A hearth roll with a cermet thermal spray coating on the roll surface which is composed of a heat resistant MCrA1Y (M: Fe, Ni, Co) alloy where the amount of A1 is below 10 at. % and the combined (Al+Cr) amount is between 13–31 at. % and at least one oxide ceramic from the group consisting of MgO, $MgAl_2O_4$, and $Y_2O_3$.

5 Claims, No Drawings

HEARTH ROLL WITH SUPERIOR ENDURANCE CAPACITY

FIELD OF THE INVENTION

The current invention is designed for use as rolls which propel steel strip inside of heat treatment furnaces. Specifically, the invention is suitable for use as a hearth roll in continuous annealing furnaces to reduce buildup and increase the usable lifetime of rolls.

BACKGROUND OF THE INVENTION

Heat treatment furnaces used in the annealing of steel strip are equipped with hearth rolls in the furnace to allow for a continuous annealing process. These rolls operate in temperatures ranging from 600° C.–1200° C. and in a weak oxidizing atmosphere. They must be able to maintain the capability to transport the high temperature steel strip over long periods of continuous operation. As a result of the severe conditions, the rolls are subject to several potential problems, including wear of the roll surface, and adhesion to the roll surface of oxide or iron dust type particulate matter which may be transferred from the strip to the roll during operation. This type of adhered matter is referred to as buildup.

The most effective means of stopping the buildup phenomena is to create a ceramic layer on the surface of the hearth roll. This was proposed in Japan Patent Application Showa 64-258. A roll with this type of layer was effective in reducing buildup on the roll surface, but the layer was also brittle and subject to spallation through thermal cycling. Alternatively, a layer such as the one proposed in Japan Patent Application Showa 60-14186, consisting of a heat resistant alloy layer on the roll surface was effective against spallation but ineffective with respect to buildup. A variety of cermet materials have also been proposed and introduced to achieve a layer which would resist spallation, and also reduce the incidence of buildup on the roll surface. These proposals include th following:

1. Japan Patent Application Heisei 2-270955: Thermal spray material of NiCrAlY with 5–20% $Cr_2O_3$—$Al_2O_3$ addition.

2. U.S. Pat. No. 4,822,689: MCrAlY (where M is Fe, Ni, or Co) with 51–95 vol. % $Al_2O_3$.

3. Japan Patent Showa 63-47379: MCrAlY (where M is Fe, Ni, or Co) with 30–80 vol. % $ZrSiO_4$; chrome oxide densification treatment.

4. Japan Patent Application Showa 63-47379: MCrAlY (where M is Fe, Ni, or Co) with 40% $SiO_2$.

5. Japan Patent Application Showa 60-56058: Multilayered $Al_2O_3$—$MgO_4$ crystalline metal with the top layer composed of $Al_2O_3$—MgO.

The above cermet materials have all been introduced and used as hearth roll coatings, with relatively good success in resolving the problems indicated in the previous section. However, recent years have seen a result of an investigation into the reasons for the decrease in usable lifetime and measures adopted to address the problem, resulting in a hearth roll with superior buildup and wear resistance, coupled with an extended usable lifetime.

OBJECT OF THE INVENTION

An object of the invention is to supply a hearth roll which prevents buildup through development of a thermal spray coating from cermet material, maintaining superior spallation and thermal shock resistance, and ultimately achieving a longer usable lifetime for hearth rolls used in continuous annealing lines.

SUMMARY OF THE INVENTION

The initial step taken by the inventors was to identify the reason why the usable lifetime of hearth rolls had begun to decrease.

During the steel sheet annealing process, manganese present in the composition of the steel is oxidized into manganese oxide. This oxide is concentrated on the surface of the strip and is transferred during the process to the surface of the hearth rolls.

As a result of solid state reactions between the manganese oxide and heat resistant alloys making up the roll coating materials, the longevity of the hearth rolls is reduced.

The reason for the coating breakdown was determined to be from a reaction of the manganese oxide with the $Al_2O_3$ present in the heat resistant alloy. As a result, research was done to determine the minimum amount of $Al_2O_3$ which could be safely included in the heat resistant alloy. Results showed this could be achieved by inclusion of less than 10 atomic percent Al and a combined Al+Cr total of between 13 atomic percent and 31 atomic percent in a standard MCrAlY alloy (where M may be Fe, Ni, or Co). When a heat resistant alloy of this type was combined with an oxide ceramic (composition 5–90 weight percent of the total) having low reactivity with manganese oxide, a cermet coating material matching the objectives described above was achieved.

The inventors recognized the necessity of replacing the $Al_2O_3$ in the cermet coating material with a different oxide possessing similar qualities. The most likely candidates for replacing Al (Group III, light metal) appeared to be those elements whose oxides were more stable at high temperatures, such as Mg (Group II, light metal) and Y (Group III, rare earth). By investigating the effects of using the oxides of these metals (MgO), $Y_2O_3$) the present invention was achieved.

Evaluation of a hearth roll which had become unusable in a short time showed that a solid state reaction on the surface of the roll between manganese oxide and constituents of the coating had produced reaction by-products. The mechanism by which these solid state reaction products containing large amounts of manganese oxide were produced is described below.

It is well known that at the annealing temperatures of over 800° C. consistently maintained in a continuous annealing furnace, the manganese present in the steel strip can be oxidized by such things as the minuscule water vapor pressure in the furnace and become concentrated on the surface of the steel strip. During the continuous annealing process, the manganese present in the steel strip forms a stable oxide layer on the surface of the strip. In recent years, with strip produced for automobile bodies as a prime example, the trend has been moving towards increased production of extremely low carbon steels which have increased percentages of manganese. This manganese is then transferred from the steel strip to the surface of the hearth rolls during annealing operations, where it accumulates on the hearth roll surface.

Research conducted by the inventors demonstrated that when earlier coating materials were placed in a replica of the annealing furnace environment in contact with manganese oxide, a solid state reaction occurred which would lead to degradation of a coating in a short period of time. This confirmed the hypothesis that the reason for the decreased lifetimes of the hearth rolls was due to solid state reactions of the roll coating material with manganese oxide that occurred under the heating and sustained high temperature environment of the continuous annealing line.

The next step was to evaluate the resistance to manganese reaction of various MCrAlY heat resistant alloys and various oxides. As shown in Examples 1 and 2, the combination of an Al amount below 10 at. % and a combined (Al+Cr) amount between 13–31 at. % in a heat resistant alloy with $MgAl_2O_4$, MgO, or $Y_2O_3$ added separately or combined showed vast improvements in controlling the solid state reaction with manganese oxide.

By reproducing the reactions that occur between manganese oxide and $Al_2O_3$, $Cr_2O_3$ and other oxides under the conditions found in a continuous annealing line, the inventors recognized the process by which the lifetime of hearth rolls coated with standard coating materials were being shortened. These reactions produced highly brittle oxides such as $MnAl_2O_4$ and $Cr_{1.5}Mn_{1.5}O_4$. Therefore, from a standpoint of reducing the coating embrittlement occurring through reaction with manganese oxide, it is favorable to reduce the amount of Al in the heat resistant alloy component of the coating. However, the Al is necessary to prevent excess oxidation of the coating. If the combined level of Al and Cr can be kept high, though, this high temperature oxidation may be controlled. As a result of tests described in Example 1, the inventors recognized an inclusion of Al kept below 10 at. % was the best solution to the problem.

If the amount of Al is brought above 10 at. %, tests showed that an alumina layer formed easily on the coating surface and embrittlement due to the manganese oxide occurred.

On the other hand, to give the coating sufficient wear resistance, it was necessary to find an oxide with low resistance to manganese oxide to replace the $Al_2O_3$. The results of this investigation were to identify magnesia (MgO) and magnesia spinel ($MgAl_2O_4$).

Additionally, use of yttria ($Y_2O_3$) achieves the same result as magnesium powders and creates a dense coating layer.

Results showed that use of any single material from the group of magnesia spinel ($MgAl_2O_4$), magnesia (MgO) and yttria ($Y_2O_3$), or any combination of these materials gave the same effect as the use of magnesia alone.

When any or all of these oxides are combined with the heat resistant allow an addition of under 5 at. % produces an effect too small to have any use. However, an addition of more than 90 at. % makes the resulting coating brittle and prone to spallation. As a result, a cermet coating material which has a range between 5–90 at. % oxide added to the heat resistant alloy is preferred.

The following application examples describe the operation of the invention in greater detail.

EXAMPLE 1

Three types of MCrAl heat resistant alloy powders shown as No. 1–3 in Table 1 below were blended with 25 wt. % MnO and heated for 100 hours at 1000° C. in a 2%$H_2$+$N_2$ atmosphere. The same coating materials were also used to produce a sample coating done by detonation gun methods on 50×50×10 mm SUS 304 test blocks. After grind finishing, these samples were placed in contact with MnO and tested under the same conditions described above. Following the test, these samples were fixed with epoxy, cut, and mounted for cross-section examination and EDX analysis. In order to examine the degree of MnO corrosion, X-ray analysis was undertaken to determine the composition of the corrosion products. The cumulative results of these tests are described in Table 1.

The results of the tests clearly show that Sample 3, falling within the range of the current invention, had better performance than any of the earlier heat resistant alloys in terms of preventing MnO corrosion.

TABLE 1

Comparison of MnO Corrosion of Several Heat Resistant Alloys

| Sample # | Composition of Heat Resistant Alloy | Atomic % Al | CR | Al + Cr | Level of MnO Corrosion | Material Classification |
|---|---|---|---|---|---|---|
| 1 | Co-25Cr-10TA-7.5Al-0.8Y-0.7Si-2C | 16 | 27 | 43 | High | Comp. |
| 2 | Co32Ni-21Cr-8Al-0.5Y | 16 | 21 | 37 | High | Comp. |
| 3 | Ni-16Cr-4.5Al | 9 | 17 | 26 | Low | Inv. |
| 4 | Co-20Cr-4Al | 8 | 20 | 28 | Lows | Inv. |

Comp: Comparison Material
Inv.: Material in scope of invention

EXAMPLE 2

The oxide powder coating material No. 4–13 were evaluated under the same test conditions as those described in Example 1 to determine their resistance to corrosion by MnO. The evaluation criteria were also identical to those described in Example 1. the test results are summarized in Table 2. MnO corrosion was greatest for $Al_2O_3$ (No. 4), $SiO_2$ (No. 5), and blended materials with large amounts of $Al_2O_3$ (No. 12). Moderate corrosion from the MnO was shown by $Cr_2O_3$ (No. 6), $Al_2O_3$—$Cr_2O_3$ (No. 7) and $ZrSiO_4$ (No. 8). The best results were achieved with the materials listed in the current invention, including $Y_2O_3$ (No. 9), $MgAl_2O_4$ (No. 10), MgO (No. 11), and NiCoCrAlY (3 wt. % Al ) (No. 13), which showed almost no reactivity with MnO. The large amounts of Mn found in the corrosion products as a result of the experiment provide additional proof that the degradation of the actual rolls is due to the presence of MnO. Under these conditions as well it is clear that the oxides claimed in the current invention do not react with MnO.

TABLE 2

Comparison of MnO Corrosion of Several Oxide Powders

| Sample # | Coating Material | Product | Level of MnO Corrosion | Material Classification |
|---|---|---|---|---|
| 4 | $Al_2O_3$ | $MnAl_2O_4$ | High | Comp. |
| 5 | $SiO_2$ | $Mn_2SiO_4$ | High | Comp. |
| 6 | $Cr_2O_3$ | $Cr_{1.5}Mn_{1.5}O_4$ | Medium | Comp. |
| 7 | $Al_2O_3$—$Cr_2O_3$ | Mixed Oxides | Medium | Comp. |
| 8 | $ZrSiO_4$ | $Mn_2SiO_4$ | Medium | Comp. |
| 9 | $Y_2O_3$ | | Low | Inv. |
| 10 | $MgAl_2O_4$ | | Low | Inv. |
| 11 | MgO | | Low | Inv. |
| 12 | CoCrTaAlY (10 wt % Al) | $MnAl_2O_4$ | High | Comp. |
| 13 | NiCrAlY (3 wt % Al) | | Low | Inv. |

Comp.: Comparison Material
Inv.: Material within scope of invention

EXAMPLE 3

In order to compare the effect of the current invention to prior art coating materials, a comparison of coating performance was made.

50×50×10 mm coating test pieces were made by detonation gun techniques of the coating materials listed in Table 3. After coating, the samples were placed in contact with Fe powder and MnO powder in a 2% $H_2$+$N_2$ atmosphere, heated to 800–1000° C. and held before quenching. Following the quench the samples were exposure tested for 300 hrs. under atmospheric conditions. In order to evaluate the resistance of the coatings to thermal shock, cyclic testing of the samples was done by heating to 950° C. and rapidly quenching in cold water.

Results of the tests are shown in Table 3.

TABLE 3

Results of coating Comparison for Thermal Shock, MnO Resistance

| Sample # | Coating Material | Fe Powder Adhesion | MnO Corrosion Level | Thermal Shock Resistance | Material classificaton | Al + Cr (at. %) |
|---|---|---|---|---|---|---|
| 14 | CoCrTaAlY + 10 wt % $Al_2O_3$ | 2 | C | ≧20 | Comp. | 43 |
| 15 | $MgAl_2O_3$ | 1 | A | 1 | Comp. | — |
| 16 | CoCrTaAlY + 30 wt % $Al_2O_3$ | 1 | C | ≧20 | Comp. | 43 |
| 17 | CoCrTaAlY + 10 wt % $CrSi_2O_3$ | 1 | C | — | Comp. | 37 |
| 18 | CoCrTaAlY + 10 wt % $ZrSi_2O_4$ | 1 | C | — | Comp | 37 |
| 19 | NiCrAlY + $MgAl_2O_4$ + $Y_2O_3$ | 2 | A | — | Inv. | 26 |
| 20 | NiCrAlY + 10 wt.% $MgAl_2O_4$ | 2 | B | — | Inv. | 26 |
| 21 | NiCrAlY + 30 wt. % $MgAl_2O_4$ | 1 | A | ≧20 | Inv. | 26 |
| 22 | NiCrAlY + 30 wt. % $Y_2O_3$ | 2 | A | ≧20 | Inv. | 26 |

Comp: Comparison Material
Inv.: Material in scope of invention
(Fe Evaluation)
1. Almost no adhesion
2. Small amounts of Adhesion; easily removable
3. Adhered material could not be easily removed (MnO Evaluation)
A. Surface roughness unchanged from pre-test measurement
B. Formation of Mn-containing oxides on surface
C. Surface roughness much rougher than pre-test measurements As described in the preceding material, a hearth roll employing the coating materials of the current invention has virtually no adhesion from Fe, is not subject to corrosion by MnO and possesses superior thermal shock resistance when compared to hearth rolls made using prior art coating technology.

I claim:

1. A continuous annealing furnace for annealing sheet strips which employs a hearth roll characterized by a cermet thermal spray layer on the surface of the roll body where the thermal spray layer is composed of (1) a heat resistant MCrAlY alloy where M is at least one metallic element from the group of Fe, Ni, and Co, with the amount of Al to be below 10 at. % and the combined amount of Al and Cr between 13 at. % and 31 at. % combined with (2) an oxide ceramic constituting between 5–90 wt. % of the thermal spray coating which has low reactivity with manganese oxide.

2. The hearth roll described in claim 1 where the oxide ceramic having low reactivity with manganese oxide is magnesia spinel ($MgAl_2O_4$).

3. The hearth roll described in claim 1 where the oxide ceramic having low reactivity with manganese oxide is magnesia (MgO).

4. The hearth roll described in claim 1 where the oxide ceramic having low reactivity with manganese oxide is yttria ($Y_2O_3$).

5. The hearth roll described in claim 1 where the oxide ceramic having low reactivity with manganese oxide is a material derived from a combination of at least two oxides chosen from the group of magnesia spinel ($MgAl_2O_4$), magnesia (MgO), and yttria ($Y_2O_3$).

* * * * *